United States Patent [19]

Altwicker et al.

[11] Patent Number: 4,566,182

[45] Date of Patent: Jan. 28, 1986

[54] ACTUATING ASSEMBLY FOR THE PRIME MOVERS OF RIVETING PRESSES AND THE LIKE

[75] Inventors: Gerd Altwicker, Eschweiler; Wilhelm Eiringhaus, Stolberg, both of Fed. Rep. of Germany

[73] Assignee: William Prym-Werke KG, Stolberg, Fed. Rep. of Germany

[21] Appl. No.: 598,989

[22] Filed: Apr. 11, 1984

[30] Foreign Application Priority Data

Apr. 15, 1983 [DE] Fed. Rep. of Germany ..... 3313652

[51] Int. Cl.[4] ..... B23P 21/00; B23Q 15/00; D05B 3/12

[52] U.S. Cl. ..... 29/715; 29/243.53; 29/283.5; 29/DIG. 3; 112/104; 227/7; 227/8; 264/249; 414/667

[58] Field of Search ..... 29/DIG. 3, 709, 714, 29/715, 243.53, 283.5; 112/2, 104; 264/242, 249; 414/677; 227/3, 6, 7, 8

[56] References Cited

U.S. PATENT DOCUMENTS

| | | | |
|---|---|---|---|
| 2,509,870 | 5/1950 | Larsson | 227/6 |
| 2,935,434 | 5/1960 | Dawson | 29/243.53 |
| 3,599,854 | 8/1971 | Pearson | 227/7 |
| 3,602,418 | 8/1971 | Erhardt, Jr. | 227/3 |
| 3,677,456 | 7/1972 | Ramspeck et al. | 227/8 |
| 3,677,457 | 7/1972 | Ramspeck et al. | 227/8 |
| 3,713,573 | 1/1973 | Fehrs | 227/8 |
| 3,741,459 | 6/1973 | Arkush, Jr. | 227/3 |
| 4,059,889 | 11/1977 | Randolph et al. | 29/709 X |
| 4,161,271 | 7/1979 | Bussard | 227/8 |
| 4,380,109 | 4/1983 | Pray | 29/243.53 X |

*Primary Examiner*—Howard N. Goldberg
*Assistant Examiner*—Ronald S. Wallace
*Attorney, Agent, or Firm*—Peter K. Kontler

[57] ABSTRACT

A riveting press wherein the motor for the movable riveting tool is started in automatic response to closing of two discrete switches. One of the switches can be closed by a rivet which is already applied to a workpiece, such as a piece of textile material, and such one switch is located at a variable distance from the riveting tools. The other switch is also located at a selected distance from the riveting tools and can be closed by a marginal portion of the workpiece whereby the tools automatically apply a rivet to that part of the workpiece which is disposed therebetween while the two switches are closed.

18 Claims, 3 Drawing Figures

ACTUATING ASSEMBLY FOR THE PRIME MOVERS OF RIVETING PRESSES AND THE LIKE

BACKGROUND OF THE INVENTION

The present invention relates to riveting presses and analogous machines in general, and more particularly to improvements in machines of the type wherein one-piece or multi-piece rivets, clamps, hooks, eyelets, buttons or like articles of hardware are to be affixed to selected portions of workpieces, such as textile materials which are being converted into jackets, jeans and other types of garments. For the sake of simplicity, the following description will refer primarily to riveting presses of the type wherein two components of a hollow rivet or an analogous or similar article of hardware are assembled by being pressed or otherwise forcibly moved toward, against or into each other.

In many presently known riveting presses, the making of a rivet is effected by depressing a foot pedal which starts a motor serving to move a first tool toward a second tool and/or vice versa. Prior to depressing the pedal, the person in charge of operating the press must carefully place a selected portion of a textile or other workpiece into a predetermined position for the application of a rivet thereto, e.g., by ensuring that the selected portion of the workpiece is located between a stationary lower riveting tool and a mobile upper riveting tool which latter, for the purpose of permitting a shifting of the workpiece, is normally held in a raised or retracted position. Such riveting presses are further provided with suitable gauges and stops in order to facilitate the work of the attendant in properly positioning a selected portion or successive selected portions of the workpiece relative to the tools. Nevertheless, the attendant must exercise great care prior to each depression of the pedal in order to ensure that a selected portion of the workpiece is in fact located in an optimum position for the application of a rivet thereto. Frist of all, such mode of operating the press consumes much time and the output of the press is overly dependent upon the carefulness and conscientiousness of the operator. Secondly, the work is fatiguing and the likelihood of application of rivets in other than optimum positions increases as the day progresses. Furthermore, manual positioning of the workpiece in the above outlined manner simply cannot be performed with a degree of precision which is often expected from discriminating purchasers of certain types of garments. Last but not least, the operation of such types of presses requires a relatively long interval of training which also contributes to higher cost of the ultimate products.

OBJECTS AND SUMMARY OF THE INVENTION

An object of the invention is to provide a riveting press or an analogous machine wherein the positioning of selected portions of workpieces with reference to the article applying tool or tools requires less time and can be carried with a much higher degree of accuracy than in heretofore known machines.

Another object of the invention is to provide a machine of the above outlined character with novel and improved means for simplifying the task of the attendants in properly applying rivets, buttons, clamps, hooks and/or other articles of hardware (metallic or plastic) to incipient, semifinished or finished garments or other types of workpieces.

A further object of the invention is to provide a riveting press or an analogous machine wherein the application of an article of hardware to the workpiece need not be directly initiated by the attendant.

An additional object of the invention is to provide a press or an analogous machine wherein the application of each and every one of a short or long series of articles of hardware to a given workpiece can be carried out with the same degree of accuracy and predictability.

Still another object of the invention is to provide a riveting press or an analogous machine whose manipulation is less tiresome than that of conventional machines of such character.

An additional object of the invention is to provide a novel and improved method of facilitating the application of rivets, hooks, clamps, buckles, buttons and/or other types of metallic or plastic articles of hardware to pieces of textile material or the like.

Another object of the invention is to provide a riveting press or an analogous machine with novel and improved means for automatically initiating the application of an article of hardware to a workpiece in response to proper positioning of a selected portion of the workpiece relative to the article applying means.

The invention is embodied in a machine for the application of rivets or analogous articles of hardware to workpieces of textile or other material of the type having a marginal portion. The machine comprises article applying means (e.g., two tools one of which is movable relative to the other to thereby join two components of a composite rivet so that the two components are disposed at the opposite sides of the workpiece), prime mover means (e.g., an electric motor) which is actuatable to operate the article applying means (e.g., by moving the one tool relative to the other tool of such article applying means), a table, platform or analogous means for movably supporting the workpiece (e.g., in a horizontal plane) so that selected portions of the workpiece can be located in the range of the article applying means (e.g., between the two tools), at least one first actuating means which is activatable by an applied article on the workpiece and is disposed at a preselected (preferably variable) distance from the article applying means such as corresponds to the desired mutual spacing of two articles on the workpiece, at least one second actuating means which is activatable by the marginal portion of the workpiece on the supporting means and is disposed at a predetermined (preferably variable) distance from the article applying means, and means for operatively connecting the first and second actuating means with the prime mover means so as to actuate the prime mover means in response to simultaneous activation of both actuating means. Each of the actuating means can comprise electric switch means, preferably microswitches, if the prime mover means constitutes or includes an electric motor or any other electrically operated motion imparting device. The first actuating means further comprises means for changing the condition of (e.g., closing) the respective electric switch means in response to engagement by the applied article on the workpiece. The second actuating means can comprise sensor means which is displaceable by the marginal portion of the workpiece on the supporting means to thereby change the condition of (e.g., close) the respective switch means. As mentioned above, at least one of the actuating means is preferably movable with reference to the article applying means to thereby vary the distance between the movable actuating means and the article applying means in order to enhance the versatility of the machine.

In accordance with a presently preferred embodiment of the invention, the first actuating means comprises electric switch means (e.g., a microswitch) and means for changing the condition of (e.g., closing) the switch means. The condition changing means can include a movable trip or sensor and means for yieldably biasing the trip to a first position. The trip is movable from the first position to a second position against the opposition of the biasing means to thereby change the condition of the switch means in response to engagement by an applied article on the workpiece, e.g., in response to engagement by one head of a two-piece rivet. The first actuating means of the just outlined character can further comprise guide means for the trip (e.g., a sleeve-like casing wherein the trip is reciprocable between the first and second positions). Such guide means can be provided with a socket for the applied article on the workpiece (e.g., for one head of a rivet) whereby the applied article which is inserted into the socket moves the trip from the first to the second position against the opposition of the biasing means. The applied article can be inserted into the socket by hand or automatically by resorting to a suitable inserting mechanism. The first actuating means can be mounted on a carrier having a track along which the first actuating means is movable relative to the article applying means to thereby vary the distance between the first actuating means and the article applying means. The carrier can include a table having a slot along which the guide means of the first actuating means is movable, and such machine preferably further comprises means for releasably securing the guide means in a selected portion of the slot. The table which forms part of or constitutes the carrier for the first actuating means can be disposed at a level below the table which includes or constitutes the supporting means for the workpiece. The machine can comprise several first actuating means each of which is connected with the prime mover means, each of which is activatable in lieu of the other first actuating means and each of which can be disposed at a different distance from the article applying means. If the prime mover means is or includes an electric motor or the like, each of the first actuating means can comprise an electric switch and means for changing the condition of the respective switch in response to engagement by an applied article on the workpiece.

In accordance with a presently preferred embodiment of the invention, the second actuating means comprises an electric switch (e.g., a microswitch) and means for changing the condition of (e.g., closing) the switch. The condition changing means can include a sensor or trip and means for biasing the sensor to a first position. The sensor is movable to a second position, in which it changes the condition of the switch, by the marginal portion of the workpiece on the supporting means. Such sensor can include a lever which is pivotable between the first and second positions, and the second actuating means can further comprise a housing for the lever. The housing is provided with an opening through which the lever extends to assume its first position under the action of the biasing means. A portion of the lever extends outwardly through the opening of the housing when the lever is free to assume its first position, and such portion can be engaged by the marginal portion of the workpiece on the supporting means to thereby pivot the lever to the second position. Such portion of the lever can be provided with a substantially convex surface which can be engaged by the marginal portion of the workpiece on the supporting means.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

In the following description of certain specific embodiments and in the appended claims, the term "article" or "articles" is intended to embrace all kinds of metallic and/or synthetic plastic hardware which can be applied to sheets, webs, panels or other types of textile or similar material and can assume the form of buttons, one-piece or composite rivets, clamps, hooks, components of snap fasteners, eyelets and many others. In addition, the term "riveting" is intended to embrace all kinds of upsetting, rolling, clinching, hammering, bending, buckling and/or analogous deforming or coupling operations which may be necessary to deform a single component of an article of hardware, to deform several components of a composite article of hardware or to otherwise couple several components of an article of hardware so as to establish a permanent or separable connection between such components and/or between one or more components and a workpiece. By way of example, the improved machine can be utilized to introduce the shank of a first rivet head into the sleeve of a second rivet head in such a way that the two components together constitute a finished rivet whose central portion (namely the sleeve and the shank therein) extends through the material of the workpiece so that one head of the finished article is located at one side and the other head of such article is located at the other side of the workpiece. It is also possible to use the machine to force the shank of a rivet head from one side through the material of the workpiece and into and through a washer, cap or a like component at the other side of the workpiece.

Figure 1:
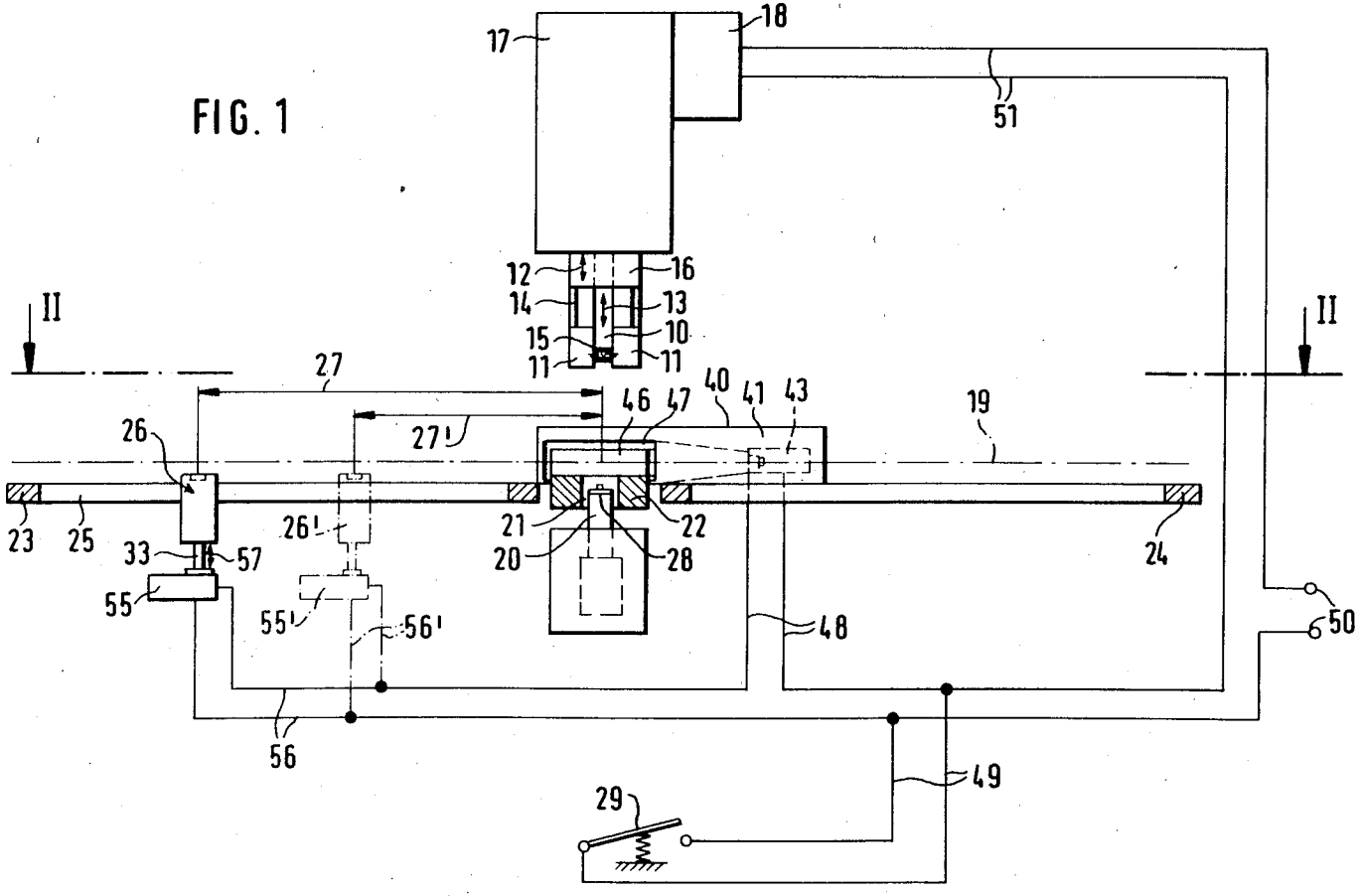
FIG. 1 is a fragmentary schematic partly elevational and partly vertical sectional view of a riveting press which embodies the invention and comprises several first actuating means, the section being taken in the direction of arrows as seen from the line I—I of FIG. 2.
Figure 2:
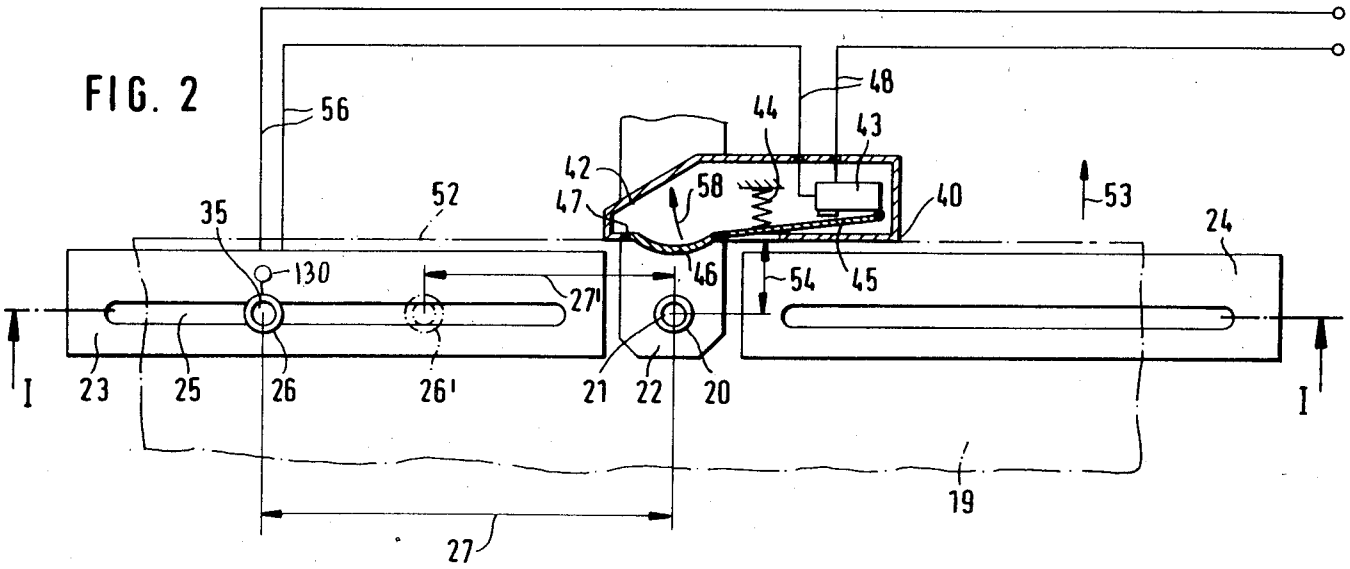
FIG. 2 is a fragmentary schematic horizontal sectional view as seen in the direction of arrows from the line II—II of FIG. 1.

The riveting press which is shown in FIGS. 1 and 2 comprises an article applying unit which includes a lower or first tool 20 disposed at a level below the plane of a workpiece 19 and a composite second tool which is disposed at a level above the plane of the workpiece. The second tool includes an upright ram 10 which is reciprocable in directions indicated by a double-headed arrow 13 and two grippers or claws 11 which flank the ram 10 and are mounted on the lower end portions of leaf springs 14. The leaf springs 14 are reciprocable up and down in directions indicated by a double-headed arrow 12 and are mounted on a carriage 16 which is reciprocable by a prime mover 18, preferably an electric motor, through the medium of a suitable motion transmitting unit (not specifically shown) in a housing 17. The arrangement is such that the prime mover 18 transmits motion to the ram 10 as well as to the carriage 16 (and hence to the leaf springs 14 and the grippers 11) but that the amplitude of reciprocatory movements of the ram 10 deviates from that of the grippers 11. Also, the movements of the ram 10 are out of phase with movements of the grippers 11. Thus, the grippers 11 can descend in a first step to place a component 15 of an article to be assembled in proper position relative to a selected portion of the workpiece 19 (namely, the portion which is disposed between the ram 10 and the tool 20), and the ram 10 is thereupon caused to descend so as to ensure that the component 15 is properly united with a second component 28 which rests on the upper portion of the tool 20. The manner in which the components 15 and 28 can be supplied to the respective tools forms no part of the present invention. Reference may be had, for example, to the commonly owned copending patent application Ser. No. 598,900 filed Apr. 11, 1984 by Paul Hagmann for "Apparatus for feeding articles of hardware in riveting presses and the like". The application of Hagmann also discloses one presently preferred mode of reciprocating the ram out of phase with the grippers. When the prime mover 18 is started, the press completes a full cycle, for example, by causing two rotary cams to perform complete revolutions so that one of the cams can move the ram 10 and the other cam can move the grippers 11.

The lower tool 20 is installed in a recess 21 which is machined into or otherwise formed in a springbiased platform or table 22 constituting or forming part of a means for supporting the workpiece 19 in a predetermined plane (preferably in a horizontal or nearly horizontal plane). The application of Hagmann discloses the manner in which the platform 22 is biased upwardly and also the purpose of such biasing of the platform.

The platform 22 is flanked by two additional tables 23, 24 at least the former of which is disposed at a level somewhat below the level of the upper surface of the platform 22 and constitutes a support for a first actuating device 26 so that the latter can be maintained at any one (27) of a number of different selected distances from the article applying unit including the tools 20 and 10, 11. The illustrated distance 27 is but one of several, or an infinite number of, distances between the article applying unit and the actuating device 26.

Figure 3:
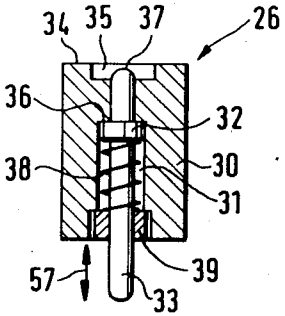
FIG. 3 is an enlarged sectional view of a portion of one of the first actuating means in the machine of FIGS. 1 and 2.

The details of a portion of the actuating device 26 are shown in FIG. 3. This device comprises a sleeve-like housing or guide 30 which can slide in the elongated slot 25 of the table 23 and has a composite vertical bore or hole 31 for a vertically recripocable pin-shaped trip or sensor 33. The latter has a collar 32 which is yieldably biased against an internal shoulder 36 of the guide 30 by a prestressed coil spring 38 or other suitable biasing means bearing against the underside of the collar 32 and reacting against an externally threaded plug 39 which is inserted into the tapped lower end portion of the bore 31. The trip 33 is movable in directions which are indicated by a double-headed arrow 57 between the illustrated first (raised) position and a second or depressed position under the action of a component 28 of an article of hardware which is already attached to the workpiece 19. The upper end face 34 of the sleeve-like guide 30 is disposed at a level somewhat above the upper side of the table 23 and has a recess or socket 35 which can receive the lower component 28 of an applied article of hardware by snap action or in another suitable way so that the introduction of such component into the socket 35 entails depression of the upper end portion 37 of the trip 33 against the opposition of the spring 38 whereby the trip 33 then assumes its second position. As shown in FIG. 3, the upper end portion 37 of the trip 33 is disposed at a level slightly below that of the end face 34 of the guide 30 when the coil spring 38 is free to maintain the trip in the illustrated first position by causing the collar 32 to bear against the internal shoulder 36. The outline of the socket 35 (which constitutes the enlarged upper end portion of the bore 31) can match or approximate that of the component 28 of an article on the workpiece 19.

The sleeve-like guide 30 is provided with one or more screws or bolts 130 (see FIG. 2) cooperating with nuts (not specifically shown) and serving to releasably fix the actuating device 26 in a selected portion of the slot 25 in the table 23. The other table 24 can also carry one or more actuating devices 26 or analogous actuating devices.

The actuating device 26 further comprises a microswitch 55 (see FIG. 1) which is connected to or otherwise movable with the guide 30 in the longitudinal direction of the slot 25 of the table 23. The condition of the microswitch 55 is changed (e.g., the microswitch is closed) in response to downward movement of the trip 33 to its second position whereby the microswitch 55 completes one portion of the electric circuit of the prime mover 18. The reference character 50 denotes in FIG. 1 a source of electrical energy and the characters 51 and 56 denote conductor means serving to operatively connect the microswitch 55 with the prime mover 18.

The means for actuating the prime mover 18 further comprises a second actuating device 40 which is disposed at a preferably variable distance from the riveting station (accommodating the tools 20 and 10, 11) and is designed to respond to engagement of its trip or sensor 45 with a marginal portion 52 of the workpiece 19. Since the workpiece 19 on the supporting means 22 is located in a substantially horizontal plane (the tables 23 and 24 can also form part of such supporting means for the workpiece), the second actuating device 40 is provided with a substantially or exactly vertical stop face 41 against which the marginal portion 52 of the workpiece 19 must abut when the prime mover 18 is to be started in order to initiate the completion of a working cycle, i.e., the coupling of a component 28 on the lower tool 20 with a component 15 between the grippers 11. The actuating device 40 comprises a housing or casing 42 which can be installed at a variable distance from the riveting station (e.g., on a portion of the supporting means 22) and accommodates the aforementioned trip or sensor 45 which is a one-armed lever pivotally mounted on the casing of a microswitch 43 in the interior of the housing 42. The latter has an opening 47 for a substantially spoon-shaped portion 46 of the lever 45, and a coil spring 44 is provided to bias the lever 45 to a first position which is shown in FIG. 2 and in which the convex side of the portion 46 extends outwardly beyond the opening 47 in the housing 42. In such first position of the lever 45, its portion 46 extends beyond the vertical stop face 41 of the housing 42 and toward the riveting station. When the convex side of the portion 46 is engaged by the marginal portion 52 of the workpiece 19 on the supporting means 22, the lever 45 is pivoted to a second position (see the arrow 58) against the opposition of the spring 44 and changes the condition of (e.g., it closes) the microswitch 43. The latter is operatively connected with the prime mover 18 by conductors 48 and the aforementioned conductors 51. It will be seen that the microswitches 43, 55 are connected in series so that the circuit of the prime mover 18 is completed only when the microswitch 43 is closed simultaneously with the microswitch 55.

The riveting press further comprises a foot pedal 29 or other suitable means for starting the prime mover 18 independently of the condition of the microswitches 43 and 55. For this purpose, the pedal 29 forms part of a further switch which is connected with the conductors 51 by additional conductors 49.

The operation is as follows:

The aforediscussed feeding means supply components 28 to the lower tool 20 and components 15 to the grippers 11 of the upper tool at the riveting station. At such time, the leaf springs 14 are stressed because the grippers 11 are held apart in order to allow for convenient introduction of a component 15 therebetween. The springs 14 are thereupon caused to move the respective grippers 11 toward each other so that the freshly introduced component 15 is properly held at a level above the component 28 on the lower tool 20. The inner sides of the grippers 11 can be provided with recesses or the like to facilitate more predictable retention of a componcnt 15 therebetween.

The workpiece 19 is placed onto the supporting means 22 and is shifted to a position in which a selected portion thereof is ready to be connected with a first article of hardware including a component 28 (on the tool 20) and a component 15 (subsequent to attachment of the component 15 to the component 28 by the ram 10). The operator then depresses the pedal 29 to complete the circuit of the prime mover 18 which causes the grippers 11 to descend during the first stage of the thus started cycle. This entails some lowering of the supporting means 22 with attendant stressing of the aforementioned biasing means which urges the supporting means 22 upwardly. The ram 10 also descends but the rate of its downward movement is accelerated when the supporting means 22 reaches its lower end position so that the tool 20 cooperates with the rapidly descending ram 10 in order to couple the components 15, 28 to each other by causing at least a portion of one of these components to penetrate through the material of the workpiece 19 at the riveting station. The cams in the housing 17 then cause or allow the ram 10 and the grippers 11 to rise to the positions which are shown in FIG. 1 and the workpiece 19 can be shifted relative to its supporting means 22.

The pedal 29 must be depressed only to start the prime mover 18 for the application of the first article 15, 28. For then on, the prime mover 18 can be started in automatic response to each simultaneous closing of the two microswitches 43 and 55. For such purpose, the operator moves the freshly formed article 15, 28 of hardware relative to the supporting means 22 and tables 23, 24 so that the lower component 28 of such article overlies the upper end portion 37 of the trip 33 in the sleeve-like guide 30 of the first actuating device 26. This places the article 15, 28 at the distance 27 from the riveting station accommodating the article applying means. Depression of the component 28 into the socket 35 results in shifting of the trip 33 to its second positiion and automatic closing of the microswitch 55. The distance 27 is selected in such a way that it corresponds to desired spacing of the first applied article 15, 28 from the next article which is to be applied to the workpiece 19. Thus, by releasably inserting the lower component 28 of the first applied article 15, 28 into the socket 35, the operator has completed a first stage of the placing of a desired portion of the workpiece 19 into the space between the upper and lower tools of the article applying means, and the second stage is completed when the operator moves the marginal portion 52 against the projecting portion 46 of the lever 45 so that the latter is pivoted to its second position and closes the microswitch 43. The direction in which the operator normally moves the marginal portion 52 of the workpiece 19 (subsequent to insertion of the component 28 of the first article on the workpiece into the socket 35) is indicated by the arrow 53 shown in FIG. 2. At such time, the material of the workpiece 19 turns about the axis which is defined by the component 28 in the socket 35. The marginal portion 52 is then located at a preselected distance 54 from the riveting station, and the portion which is about to be provided with an article including two interconnected components 15, 28 is then located exactly above the lower tool 20 and in line of downward movement of the ram 10. The position of the housing 42 of the second actuating device 40 relative to the supporting means 22 (and hence relative to the riveting station) is preferably adjustable in any one of a number of different ways, e.g., by connecting the housing 42 to the supporting means 22 by bolts and nuts so that the bolts can slide in elongated straight or arcuate slots of the supporting means 22. This enables the operator to change the distance 54 within a desired range. The bias of the spring 44 is sufficiently weak to ensure that the marginal portion 52 can depress the portion 46 of the lever 45 and thereby close the microswitch 43 without any or without noticeable deformation of the material of the workpiece 19.

When the marginal portion 52 has caused the lever 45 to change the condition of the microswitch 43, the circuit of the prime mover 18 is completed by the two serially connected microswitches 43, 55 while the pedal 29 remains in the inoperative position which is shown in FIG. 1. The prime mover 18 then causes the machine to complete a working cycle including a downward and upward stroke of the grippers 11 (with a component 15 therebetween during the downward stroke) and a downward and upward stroke of the ram 10 to thereby attach the component 15 to the component 28 on the lower tool 20.

If necessary, the operator thereupon again shifts the workpiece 19 relative to its supporting means 22 so that the component 28 of the freshly applied second article of hardware can be inserted into the socket 35 to again close the microswitch 55. By manipulating the workpiece 19 (namely, by turning it about the axis of the component 28 in the socket 35 and, if necessary, by stretching and flattening the workpiece), the operator then causes the marginal portion 52 of the workpiece to close the microswitch 43 through the medium of the lever 45 whereby the prime mover 18 is started again to connect the workpiece with a third article including a component 28 on the lower tool 20 and a component 15 removed from the grippers 11 of the upper tool. The same procedure can be repeated again and again as often as necessary to attach a selected number of equidistant articles of hardware to the workpiece 19 at identical distances (27) from one another and at identical distances (54) from the marginal portion 52.

If the workpiece 19 is to be provided with two or more articles of hardware at different distances from one another, the table 23 can support two or more actuating devices of the type shown at 26. As shown in FIG. 1 by phantom lines, the housing or guide of a second actuating device 26' can be mounted in the slot 25 of the table 23 at a lesser distance 27' from the article applying means at the riveting station. This second actuating device 26' comprises its own microswitch 55' which is in circuit with the prime mover 18 by way of conductor means 56'. When the actuating device 26 is activated by insertion of a component into its socket 35, the actuating device 26' remains idle, and vice versa. It will be noted that the actuating devices 26 and 26' are connected in parallel. One or more additional actuating devices 26 can be provided on the table 23 and/or on the table 24, depending upon the preference of the operator and/or upon the nature of the workpiece and the selected locations for the application of articles of hardware thereto.

Analogously, the riveting press can be equipped with two or more actuating devices 40, each at a different distance from the article applying means at the riveting station.

An important advantage of the improved actuating assembly for the prime mover 18 is that, with the exception of the application of the first article of hardware, the operator need not be concerned with the pedal 29 and/or any other means for starting the prime mover because the latter is started automatically as soon as a portion of the workpiece which is to be connected with an article of hardware is located between the upper and lower tools 20 and 10, 11 at the riveting station. The pedal 29 can be omitted in its entirety if the first article of hardware is applied to the workpiece 19 prior to placing of such workpiece onto the supporting means 22. The actuating device or devices 26 or 26, 26' determine the optimum mutual spacing of applied articles of hardware, and the actuating device or devices 40 determine the optimum spacing of applied articles from the marginal portion 52 of the workpiece 19. The utilization of such actuating devices greatly simplifies the task of the operator and is less conducive to tiredness than the conventional mode of attaching articles of hardware to the material of jeans, jackets and/or other types of workpieces which can be penetrated by the one and/or other component of an article.

It is immaterial whether the operator first closes the microswitch 43 via marginal portion 52 of a workpiece 19 and thereupon closes the microswitch 55 by way of the lower component 28 of an already applied article 15, 28 or vice versa; the prime mover 18 is started only and alone when the microswitch 55 is closed simultaneously with the microswitch 43. As a rule, the operation is simpler if the component 28 of an applied article of hardware is inserted into the socket of one of the actuating devices 26, 26' ahead of closing of the microswitch 43 by the marginal portion 52. It can be said that the material of the workpiece 19 indirectly triggers the operation of the article applying means (tool 20 and ram 10) because the circuit of the prime mover 18 is completed in automatic response to placing of a desired portion of the workpiece (namely of the portion which is to be provided with an article of hardware) between the two tools. The placing of a component into the socket of the actuating device 26 or 26' and the closing of the microswitch 43 by the marginal portion 52 of the workpiece 19 are operations which are much simpler, less expensive and can be carried out with a much higher degree of accuracy than in conventional riveting presses wherein each starting of the prime mover must be initiated by depression of a pedal or the like. In other words, the operation of the rivet press which embodies the improved actuating assembly for the prime mover is not only less tiresome but is also much more conducive to exact application of articles of hardware to selected portions of the workpiece.

It is further clear that the improved riveting press and its actuating assembly are susceptible of numerous additional modifications without departing from the spirit of the invention. For example, the actuating devices with mechanically movable sensors or trips 33, 45 can be replaced with actuating devices which employ optical, magnetic, electromagnetic or electric sensors or monitoring means. Proximity switches can be used with equal or similar advantage, at least in the actuating devices 26, 26'. It has been found that, at least in many instances, the utilization of relatively simple and rather sturdy mechanical sensors is quite satisfactory.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A machine for the application of rivets and other articles of hardware to workpieces of textile or other material of the type having a marginal portion, comprising article supplying means; prime mover means actuatable to operate said article applying means; means for supporting the workpiece so that the workpiece is movable with reference to said supporting means and selected portions thereof can be located in the range of said article applying means; at least one first actuating means, said actuating means being stationary when the machine is in use and being activatable by an applied article on the workpiece and being disposed at a preselected distance from said article applying means such as corresponds to desired mutual spacing of two articles on the workpiece; at least one second actuating means activatable by the marginal portion of the workpiece and disposed at a predetermined distance from said article applying means; and means for operatively connecting said first and second actuating means with said prime mover means so as to actuate said prime mover means in response to simultaneous activation of both said actuating means while the workpiece is held at a standstill with reference to said actuating means.

2. The machine of claim 1, wherein said prime mover means includes an electric motor and each of said actuating means includes electric switch means.

3. The machine of claim 2, wherein said first actuating means further includes means for changing the condition of the respective switch means in response to engagement by the applied article on the workpiece.

4. The machine of claim 2, wherein said second actuating means further includes sensor means which is displaceable by the marginal portion of the workpiece to thereby change the condition of the respective switch means.

5. The machine of claim 1, wherein at least one of said actuating means is movable with reference to said article applying means to thereby vary the distance between such movable actuating means and said article applying means.

6. The machine of claim 1, wherein said first actuating means comprises electric switch means and means for changing the condition of said switch means including a movable trip and means for yieldably biasing said trip to a first position, said trip being movable from such first position to a second position to thereby change the condition of said switch means in response to engagement by the applied article on the workpiece.

7. The machine of claim 1, comprising several first actuating means each connected with said prime mover means, each activatable in lieu of the other first actuating means and each disposed at a different distance from said article applying means.

8. The machine of claim 7, wherein said prime mover means comprises an electric motor and each of said first actuating means comprises an electric switch and means for changing the condition of the respective switch in response to engagement by an applied article on the workpiece.

9. The machine of claim 1, wherein said second actuating means comprises an electric switch and means for changing the condition of said switch including a trip and means for biasing said trip to a first position, said trip being movable by the marginal portion of the workpiece on said supporting means to a second position in which it changes the condition of said switch.

10. The machine of claim 9, wherein said trip includes a lever which is pivotable between said first and second positions.

11. The machine of claim 9, wherein said second actuating means further comprises a housing for said lever, said housing having an opening through which said lever extends to assume said first position under the action of said biasing means, said lever having a portion which normally extends outwardly through said opening and is engageable by the marginal portion of the workpiece on said supporting means to thereby pivot said lever to said second position.

12. The machine of claim 11, wherein said portion of said lever has a substantially convex surface which is engageable by the marginal portion of the workpiece on said supporting means.

13. The machine of claim 1, wherein at least one of said first and second actuating means comprises a microswitch.

14. A machine for the application of rivets and other articles of hardware to workpieces of textile or other material of the type having a marginal portion, comprising article applying means; prime mover means actuatable to operate said article applying means; means for supporting the workpiece so that the workpiece is movable with reference to said supporting means and selected portions thereof can be located in the range of said article applying means; at least one first actuating means activatable by an applied article on the workpiece and disposed at a preselected distance from said article applying means such as corresponds to desired mutual spacing of two articles on the workpiece, said actuating means comprising electric switch means and means for changing the condition of said switch means including a movable trip, means for yieldably biasing said trip to a first position and guide means for said trip, said trip being movable from said first position to a second position to thereby change the condition of said switch means in response to engagement by the applied article on the workpiece and said guide means comprising a socket for the applied article on the workpiece whereby the applied article which is inserted into said socket moves the trip from said first to said second position against the opposition of said biasing means; at least one second actuating means activatable by the marginal portion of the workpiece and disposed at a predetermined distance from said article applying means; and means for operatively connecting said first and second actuating means with said prime mover means so as to actuate said prime mover means in response to simultaneous activation of both said actuating means.

15. The machine of claim 14, wherein the applied article is insertable into said socket by hand.

16. The machine of claim 14, further comprising a carrier for said first actuating means, said carrier having a track along which said first actuating means is movable relative to said article applying means to thereby vary the distance between the first actuating means and said article applying means.

17. The machine of claim 16, wherein said carrier includes a table having a slot for said guide means and further comprising means for securing said guide means in a selected portion of said slot.

18. The machine of claim 17, wherein said supporting means includes a substantially horizontal second table and said carrier is disposed at a level below said second table.

* * * * *